US005967355A

United States Patent [19]

Ragot

[11] Patent Number: 5,967,355

[45] Date of Patent: Oct. 19, 1999

[54] TRASH RECEPTACLE INCLUDING ILLUMINATED OUTER CONTAINER

[75] Inventor: Paul-Henri Ragot, Laval, Canada

[73] Assignee: A.L.R. Envirotech Inc., Laval, Canada

[21] Appl. No.: 08/619,440

[22] Filed: Mar. 21, 1996

[51] Int. Cl.[6] ..... B65D 90/00

[52] U.S. Cl. ..... 220/4.32; 220/908; 362/812

[58] Field of Search ..... 220/327, 662, 220/665, 908, 4.32; 362/812, 28, 29

[56] References Cited

U.S. PATENT DOCUMENTS

| | | | |
|---|---|---|---|
| 1,380,252 | 5/1921 | Richardson | 220/908 X |
| 1,424,520 | 8/1922 | Richardson et al. | 220/908 X |
| 1,816,974 | 8/1931 | Kavanagh | 362/812 X |
| 2,010,004 | 8/1935 | Berggren | 362/812 X |
| 3,228,736 | 1/1966 | Beckerman | 220/665 X |
| 3,394,832 | 7/1968 | McAllister et al. | 220/908 X |
| 4,827,645 | 5/1989 | Stamps, Jr. . | |

*Primary Examiner*—Steven Pollard
*Attorney, Agent, or Firm*—Swabey Ogilvy Renault

[57] ABSTRACT

A novel and ergonomic trash receptacle comprises an outer container and an inner trash can. The outer container includes a box-like housing mounted on a pedestal and provided with a lockable closure with the trash can being received in the box-like housing and being in communication with the outside by way of gravity closing doors mounted on the closure such that garbage introduced in the closure through the doors thereof falls into the trash can. The closure can be unlocked and pivoted upwardly to allow city workers to remove and empty the inner trash can. The box-like housing includes a series of vertical side wall assemblies which are mounted one to the other by way of extruded posts provided at the corners of the box-like housing and adapted to slidably receive the side wall assemblies. Each side wall assembly comprises inner and outer panels and an intermediate advertisement sheet therebetween such that when the closure is removed and the locking bars unlocked, the side wall assemblies can be accessed, for instance, to change the advertisement sheet or for panel repair purposes. The inner and outer panels can be made of a translucent material with lighting units being mounted within the box-like housing and to the posts thereof for rearwardly illuminating the advertisement sheet by backlighting.

23 Claims, 5 Drawing Sheets

TRASH RECEPTACLE INCLUDING ILLUMINATED OUTER CONTAINER

BACKGROUND OF THE INVENTION

1. Field of the Invention

The present invention relates to trash receptacle and, more particularly, to a novel trash receptacle including an ergonomic outer container having an extruded frame and provided with a closure and a trash can disposed therein.

2. Description of the Prior Art

Obviously, trash cans are well known in the prior art, including open-ended trash cans which are used on the sidewalks of cities for public use. Such open-ended garbage containers are problematic in view of winds which might blow away garbage from the container and also in view of the possibility for people to remove the garbage therefrom thereby generating city pollution. Furthermore, direct and easy access to the contents of garbage containers is a health hazard.

There are further problems associated with the garbage containers presently used in cities, such as the visual nuisance that such containers bring about. Indeed, garbage cans contained in wire mesh outer containers or even garbage cans having wire mesh walls instead of continuous sheet metal or plastic walls are not very attractive.

SUMMARY OF THE INVENTION

It is therefore an aim of the present invention to provide a novel trash receptacle which is practical and ergonomic.

It is also an aim of the present invention to provide a trash receptacle wherein a trash can is enclosed in an outer ergonomic container having a closure.

It is a further aim of the present invention to provide a trash receptacle wherein the closure includes self-closing doors through which garbage can be inserted by the population such as to fall into the inner garbage can, and wherein the closure is displaceable with respect to the outer container such as to allow access to the garbage can contained therein by city workers for removal of the garbage can from the outer container such as to allow the garbage can to be emptied before being returned in the outer container.

It is a still further aim of the present invention to provide a trash receptacle wherein the outer container comprises a box-like housing for receiving the trash can therein and the closure at an upper end thereof, the box-like housing having vertical corner members and horizontal cross members made by extrusion and assembled in a frame-like fashion for receiving therein rectangular panels which form the vertical walls of the box-like housing.

It is a still further aim of the present invention to provide a trash receptacle wherein the vertical panels of the box-like housing are adapted to display advertisements.

It is a still further aim of the present invention to provide a trash receptacle wherein the vertical panels of the box-like housing of the outer container are adapted to carry removable advertisements and, if so desired, illuminated advertisements.

Therefore, in accordance with the present invention, there is provided a trash collection receptacle comprising an outer housing and a inner trash collection container located in said housing, said housing defining a trash receiving opening such that trash deposited therethrough is collected in said inner container, wherein said housing comprises a frame and panel assemblies adapted to be mounted thereto, said frame being made of post means and cross member means adapted to be assembled such as to form said frame, at least one of said panel assemblies being removable from said frame.

Also in accordance with the present invention, there is provided a trash collection receptacle comprising an outer housing, a closure means mounted to said outer housing and an inner trash collection container located in said housing, said closure means defining a trash receiving opening such that trash deposited therethrough is collected in said inner container, said closure means being displaceable relative to said housing for providing access to said inner container such as to allow said inner container to be temporarily removed from said housing.

BRIEF DESCRIPTION OF THE DRAWINGS

Having, thus generally described the nature of the invention, reference will now be made to the accompanying drawings, showing by way of illustration a preferred embodiment thereof, and in which.

DESCRIPTION OF THE PREFERRED EMBODIMENTS

Figure 1:
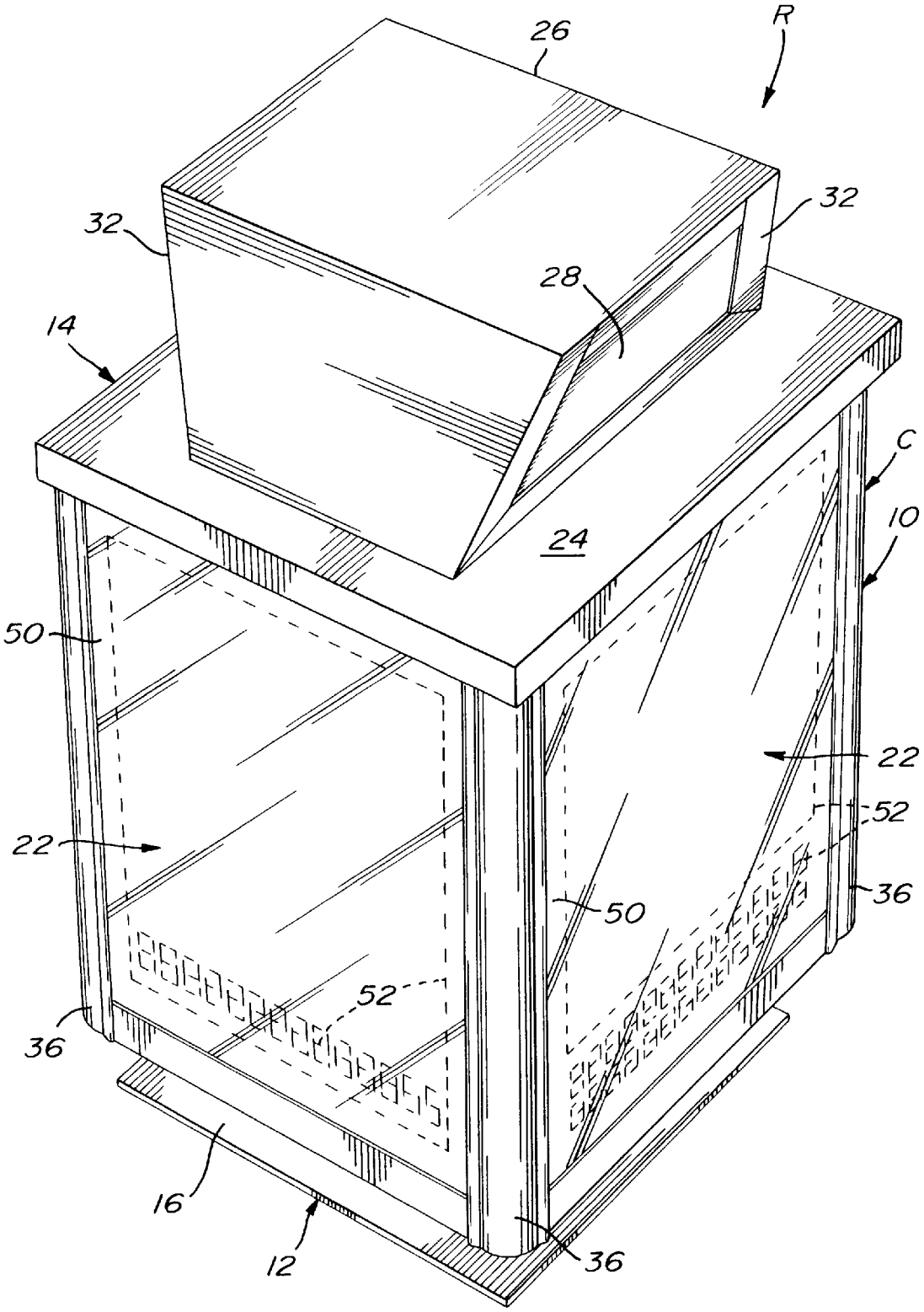
FIG. 1 is a perspective view of a trash receptacle in accordance with the present invention.
Figure 3:
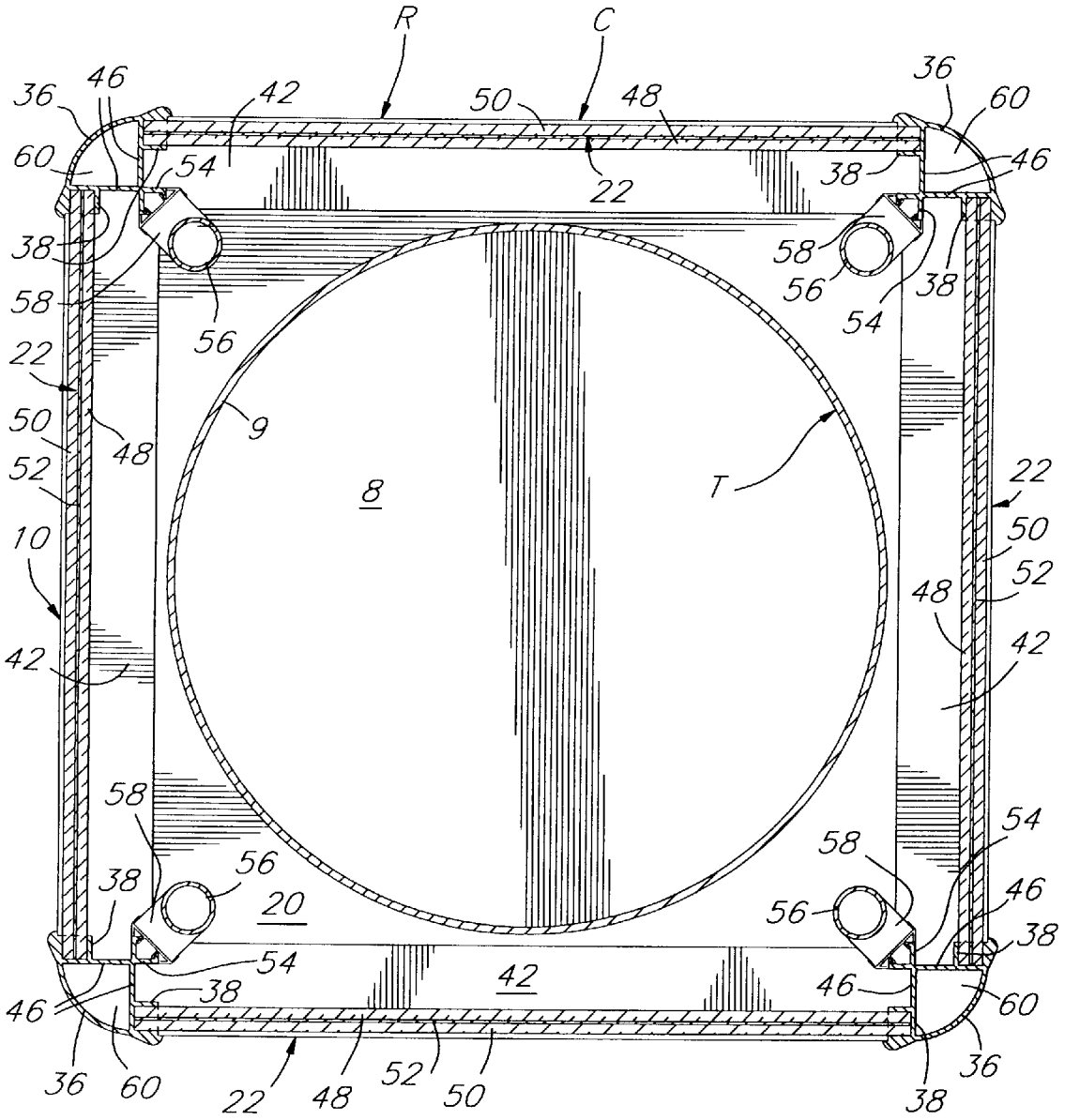
FIG. 3 is a cross-sectional view taken along line 3—3 of FIG. 2.
Figure 5:
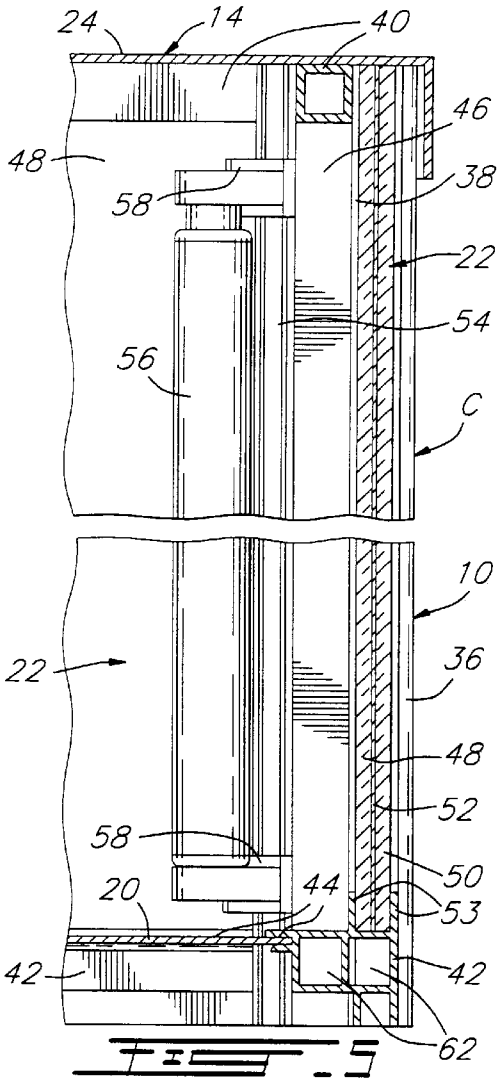
FIG. 5 is a cross-sectional view taken along line 5—5 of FIG. 4.
Figure 4:
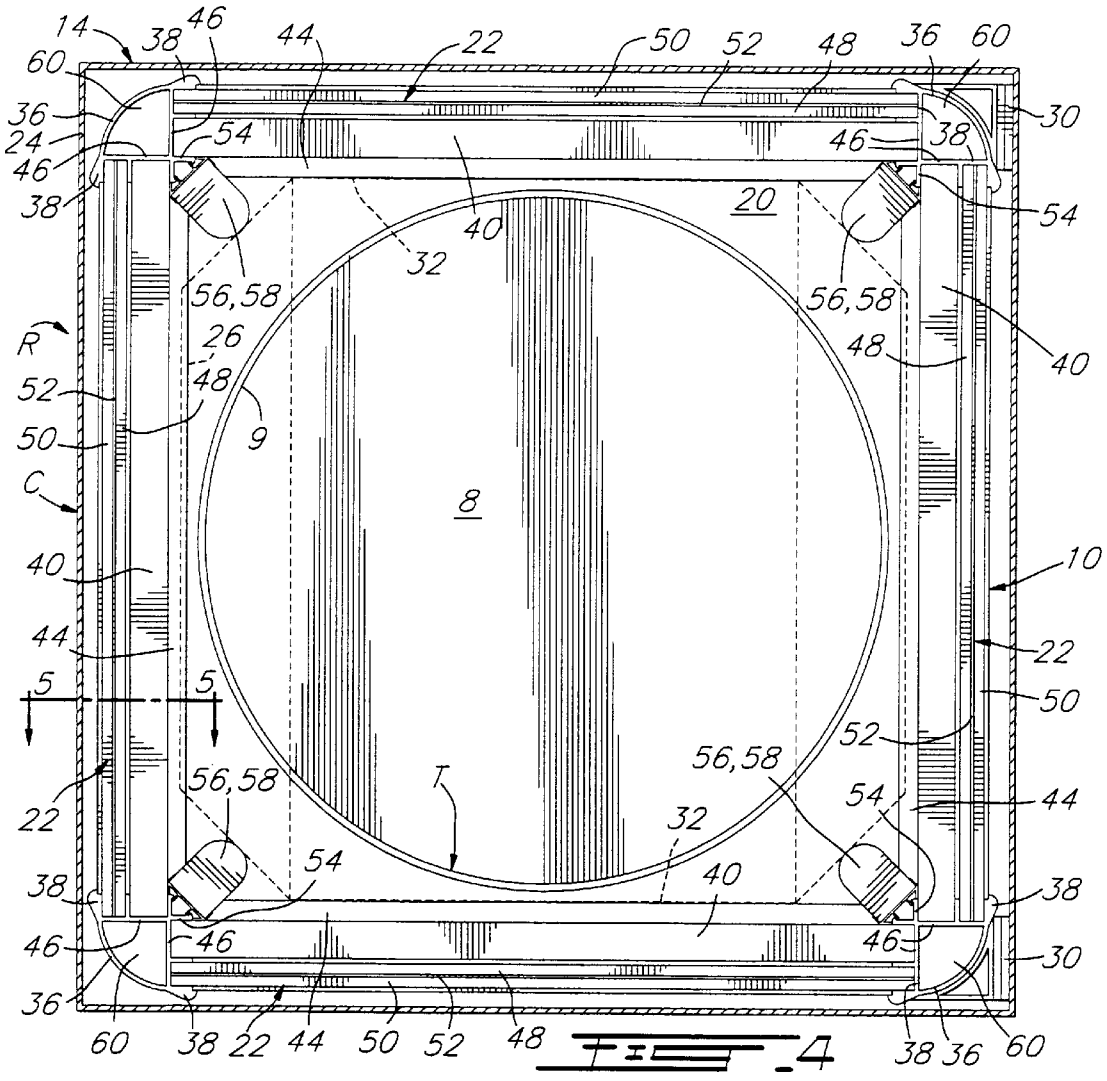
FIG. 4 is a cross-sectional view taken along line 4—4 of FIG. 2.

In accordance with the present invention, FIG. 1 shows in a perspective view a trash receptacle R which includes an outer container C and, as seen in FIGS. 3 and 4, an inner trash can T. More particularly, the trash can T is a conventional open-ended cylinder made, for instance, of a galvanized metal but which could also be made of fiberglass, PVC or other plastics materials. The trash can T has a bottom wall 8 and a cylindrical side wall 9 made with continuous sheet metal, although either one of these walls can be made as an open mesh.

The outer container C comprises a box-like housing 10 mounted on a pedestal 12 and provided at its upper end with a closure 14. In the illustrated embodiments, the pedestal 12 comprises a lower horizontal square plate 16 and an upstanding upper cylinder 18 although all sorts are geometrical shapes could be embodied in the plate 16 and in the upper member 18.

The box-like housing 10 is of the open-ended type and includes a bottom wall 20 and four composite side walls 22 extending vertically therefrom with a square-shaped horizontal profile. The closure 14 comprises a lower cover 24 which is adapted to overly the upper ends of the composite side walls 22 of the box-like housing 10, and an upper head structure 26 adapted to receive the garbage, as described in more details hereinafter. Indeed, the head structure 26 has the shape of a box which is open-ended at its bottom and which has a pair of self-closing gravity doors 28 mounted at opposed side walls thereof, in an inclined fashion, and adapted, when garbage is introduced in the closure 14 by way of the doors 28 to allow the garbage to fall through the open end at the bottom of the head structure 26 and through an inner opening defined in the cover 24 inwardly of the side walls 22 of the head structure 26 and into the trash can T.

Figure 2:
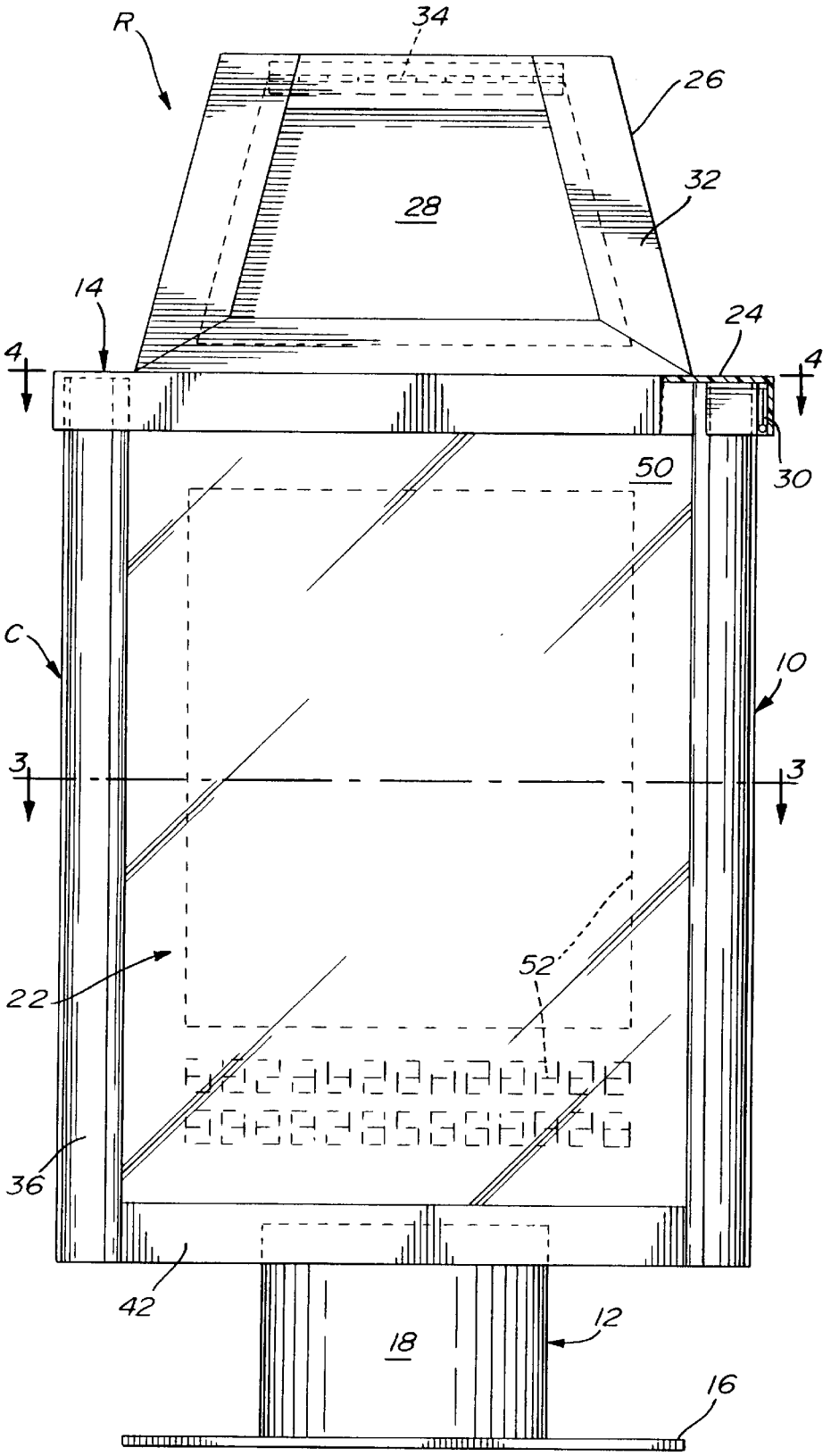
FIG. 2 is a front elevational view, shown in cross-section where fragmented, of the trash receptacle of FIG. 1.

As seen in FIGS. 2 and 4, the closure 14 is pivotally mounted at its cover 24 to the upper end of one of the composite side walls 22 of the box-like housing 10 by way of hinges 30. A lock mechanism (not shown) can be provided to secure the closure 14 onto the box-like housing 10 in the position shown throughout the drawings such as to allow only city workers to pivotally lift the closure 14 about the hinges 30 for accessing the trash can T and, more particularly, for removing the same from the outer container C to empty the trash can T before it is returned into the outer container C.

As best seen in FIG. 1, the doors 28 are mounted on opposed side walls 32 of the head structure 26 which are inclined inwardly from top to bottom with the doors 28 being mounted inwardly of these side walls 32 by way of overhead hinges 34 (see FIG. 2), whereby the doors 28, at rest, are always in the closed position thereof illustrated in FIGS. 1 and 2 in view of the gravity forces which act thereon, wherein garbage is inserted through the openings defined in the side walls 32 by pushing onto the doors 28 which pivot inwardly and upwardly within the head structure 26 of the closure 14 and against the limited gravity forces acting on these doors 28, until the garbage falls freely into the trash can T and the user removes his/her hand from within the head structure 26 thereby allowing the previously opened door 28 to return to its closed position, again by way of gravity.

It is noted that the closure 14 can take on various other shapes and proportions. For instance, all of the side walls 32 of the head structure 26 could be inclined and could all possibly be provided with a door 28. Depending on the number of sides of the box-like housing 10, the shapes of the cover 24 and of the head structure 26 will be accordingly modified. Furthermore, the present trash receptacle R can also be used without its closure 14, or with only its cover 24 and not its head structure; in both cases, the trash receptacle R is of the open-ended type, i.e. without any doors therefor.

Also, the opening of the doors 28 could be made automatic by way, for instance, of a sensor which would detect the presence of a person's hand and/or garbage when in close proximity to the doors 28. Electricity for this sensor could be readily available from a power source already present in the trash receptacle R for its illumination which is described hereinafter.

Now turning to the box-like housing 10, it is noted that the composite side walls 22 are vertically mounted by way of four extruded corner posts 36 each defining a pair of vertical side channels 38 adapted to receive the vertical sides of a pair of successive composite side walls 22. Slightly rearwardly of the composite side walls 22, upper and lower horizontal beams 40 and 42, respectively, which are preferably made by extrusion extend between each pair of adjacent posts 36 and are assembled thereto. The bottom wall 20 of the box-like housing 10 is also peripherally engaged with a horizontally extending inner groove 44 defined in the lower beams 42. The posts 36 define further vertical side channels 46 which receive the ends of the upper and lower beams 40 and 42 to form with the posts 36 four solid rectangular frames for the box-like housing 10 to which are mounted the composite side walls 22 and the bottom wall 20.

Each composite side wall 22 is, in the illustrated embodiments, made up of inner and outer rectangular panels 48 and 50, respectively, and an intermediate panel or sheet 52 disposed between the inner and outer panels 48 and 50. The inner and outer panels 48 and 50 and the intermediate sheet 52 are disposed in a sandwich-like configuration and are received at their vertical side ends into the aforementioned channels 38 of the corner post 36 while the lower horizontal ends thereof are received in an upper channel 53 defined in the lower beam 42.

More particularly, the inner panels 48 can be opaque, whereas the outer panels 50 can be made in a translucent material, such as Mica, with the intermediate sheet 52 being, for example, a cardboard advertisement which can thus be viewed from the outside and through the outer panel 50 by pedestrians and motorists. Also, by unlocking the closure 14 from the box-like housing 10, the composite side walls 22 and, more particularly, the inner and outer panels 48 and 50 and the intermediate advertisement sheet 52 can be slidably removed from engagement with the corner posts 36 by vertically and translationally displacing the side wall assemblies 22 thereby allowing the intermediate sheet 52 to be replaced by another similar sheet showing possibly a different advertisement or allowing for a damaged outer panel 50 to be replaced.

Furthermore, each corner post 36 can define between the channels 46 thereof another channel 54 to which a lighting unit 56, such as a fluorescent light tube, can be vertically mounted using a pair of brackets 58 engaged to the channel 54. The wiring (not shown) for the lighting units 56 can run through raceways in the, form of conduits 60 and 62 defined respectively in the extruded corner posts 36 and in the extruded lower beams 42. The power supply for the lighting units 56 is not shown and it is noted that a solar energy system could be used.

Once such lighting units 56 are used, the inner panels 48 are typically also made, as are the outer panels 50, of a translucent material such as to illuminate from behind (i.e. back-lighting) the intermediate advertisement sheet 52. The inner panels 48 may be made of a thinner material which allows for the light emanating from the lighting units 56 to efficiently illuminate the intermediate advertisement sheets 52, whereas the outer panels 50 will normally made of a more resistant and sturdier material for sustaining outside elements, e.g. climate-related and vandalism-related abuse as well as standard wear factors. Furthermore, in such an illuminated application, the advertisement sheet 52 is made of a translucent film (which is well known in the art), instead of cardboard, in order to accentuate the effect of the light emanating from the lighting unit 56 such that the advertisement on the intermediate sheet 52 has more impact.

Figure 7:
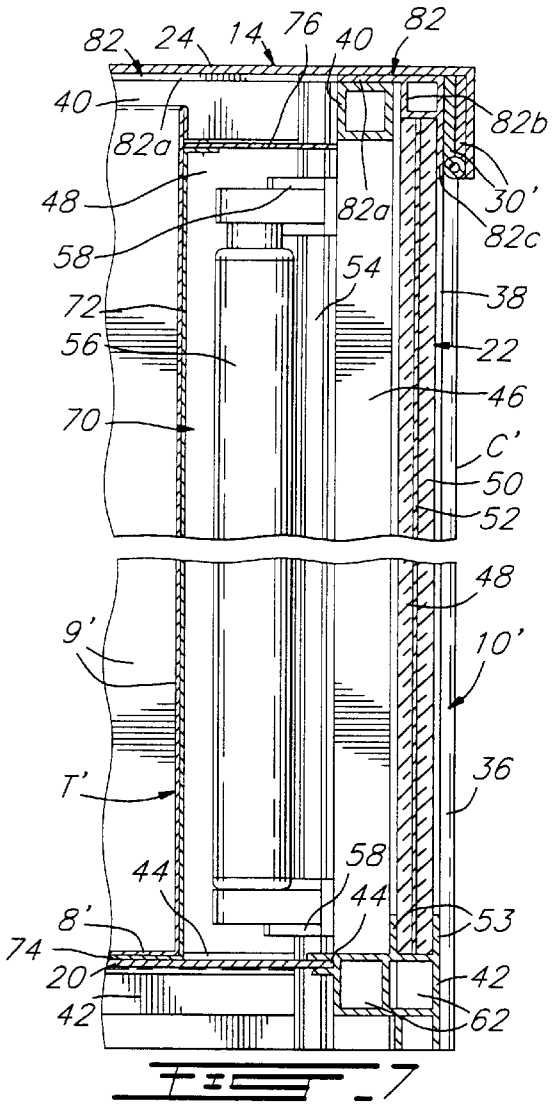
FIG. 7 is a cross-sectional view taken along line 7—7 of FIG. 6.
Figure 6:
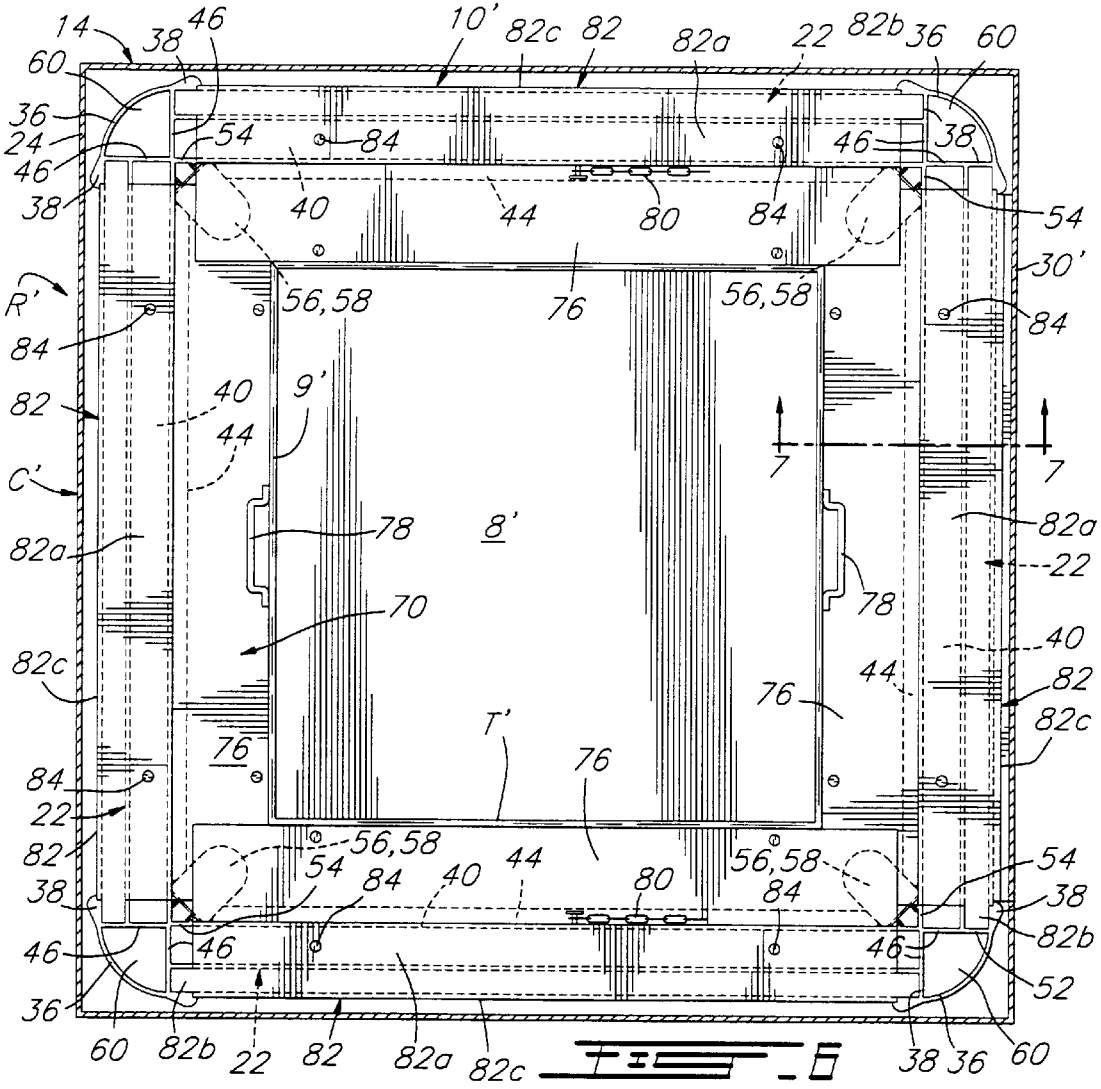
FIG. 6 is a cross-sectional view similar to that of FIG. 4 but showing a modified embodiment of the trash receptacle also in accordance with the present invention.

FIGS. 6 and 7 illustrate a variant R' of the trash receptacle R of FIGS. 1 to 5. More particularly, the trash receptacle R' includes a trash can T' having a square horizontal cross-section surrounded by a fire wall 70 extending in the outer container C' between the lighting units 56 and the trash can T'. The fire wall 70 is shaped as a square container having an out-turned horizontal flange and, more particularly, the fire wall 70 comprises a peripheral upstanding side wall 72 located between the lighting units 56 and the trash can T', a bottom wall 74 extending horizontally within the lower edges of the side wall 72 while being sandwiched between the bottom wall 91 of the trash can T' and the bottom wall 20 of the outer container C', and rectangular outwardly extending horizontal upper flanges 76 which depend from the upper edges of each side panel of the side wall 72. The fire wall 70 is required to prevent the heat generated by the lighting units 56 from causing flammable articles located in the trash can T' from igniting and also to prevent any fire in the trash can T (for instance, as a result of a lit cigarette butt being thrown therein) from damaging the outer container C', especially if the latter is made of a plastics material. The fire wall 70 could also be used with the cylindrical trash can T of FIGS. 1 to 5.

The trash can T' is provided with a pair of handles 78 for facilitating the removal thereof from the outer container C' (and also its return therein) and with a pair of chains 80 extending between a pair of opposite ones of the upper beams 40 and the closure 14 for limiting the pivot of the closure 14 way from the outer container C' when access to the latter is required (for emptying the trash can T' or for changing the advertisement sheet 52) up to a position (not shown) where the closure 14 is at an obtuse angle with respect to the outer container and is thus in a stable, gravity-induced but chain-limited, open position. The closure 14 is herein pivotally mounted to the upper beams 40 of the box-like housing 10' by way of a full length piano hinge 30'.

It is contemplated to use, instead of the chains 80, a locking hinge which would retain the closure 14 in its open position until some force is applied thereto against the mechanical and/or frictional locking mechanism of such a hinge. Also, small air cylinders could be used for the closure 14, such as smaller versions of those found on "hatchback" vehicles.

In order to prevent city workers in charge of emptying the trash can T' (and also the population at large when the trash receptacle R or R' is used without a locked closure 14) from tampering with the removable panels 48, 50 and 52 of each composite side wall 22, a locking member 82 is mounted atop each composite side wall 22 (i.e. above the panels thereof) and the upper beam 40 and extends horizontally between the corner posts 36. More particularly, the locking member 82 includes an upper plate 82*a*, a bar 82*b* and a protective front flange 82*c*. The bar 82*b* extends above the upper ends of the panels 48, 50 and 52 (see FIG. 7) and horizontally between the corner posts 36 while having its ends in the channels 38 thereof. The front flange 82*c* denies easy access to the upper ends of the panels 48, 50 and 52 when the closure 14 is open or when there is no closure on the box-like housing 10. Each locking bar 82 is removably secured to the upper beam 40 with tamper-proof screws 84 extending through the upper plate 82*a* and the upper beam 40 such as to permit only authorized personnel to access the panels 48, 50 and 52.

It is noted that, for both embodiments, the pedestal 12 could be rotatable about a vertical axis thereof such that a motorized mechanism provided with a timer could cause for the whole trash receptacle R, R' to be rotated a given angle every predetermined period of time such as to expose a different side of the box-like housing 10, 10'. Indeed, if various advertisements appear (at the sheets 52) on the different faces of the receptacle R, R', it might be useful or necessary to rotate, for instance every three of four hours, the trash receptacle R, R' about a pre-selected angle which could typically correspond to 360° divided by the number of sides or faces of the box-like housing 10, 10' and, in the case of the illustrated embodiments, this angle would thus be 90° thereby exposing each face in each of four general directions for a preset period of time.

In the above embodiments of the trash receptacle of the present invention, the extruded components are made of aluminum although plastics materials could also be used while the remaining components can be made of suitable metallic or plastics materials, except for the panels 48, 50 and 52 which, at least in the case of back-light illumination thereof, are made of appropriate plastics or plastic-like materials (or other suitable transparent materials, e.g. glass, fiberglass, etc.). Even wood or wood-like products could be used for most components of the trash receptacle.

Accordingly, it is easily seen from the foregoing that the trash receptacle R of the present invention is ergonomic and of simple and sturdy construction while substantially preventing access to the garbage contained in the trash can thereof by people other than city workers. Furthermore, the trash receptacle R allows for various advertisements to appear thereon and which can be easily changed, but only by authorized personnel and, more particularly, by persons which can unlock both the closure 14 and the locking bars 82 from the box-like housing 10 of the outer container C.

I claim:

1. A trash collection receptacle comprising an outer housing and an inner trash collection container located in said housing, said housing defining a trash receiving opening such that trash deposited therethrough is collected in said inner container, wherein said housing comprises a frame and panel assemblies adapted to be mounted thereto, said frame being made of at least two post means and of cross member means adapted to be assembled with said post means such as to form said frame, at least one of said panel assemblies being removable from said frame, said post means each defining a first set of vertical channels for removably receiving said panel assemblies, said post means provided at opposite edges of said at least one of said panel assemblies defining a second set of vertical channels for receiving the ends of at least a respective upper one of said cross member means to allow said at least one of said panel assemblies to be selectively removed from said frame without interference from said upper one of said cross member means.

2. A trash collection receptacle as defined in claim 1, wherein locking means are provided for preventing said panel assemblies from being removed from said frame, said housing comprises closure means adapted to selectively close said trash receiving opening and to be displaced relative to said housing such as to provide access to said panel assemblies for allowing said panel assemblies to be removed, and wherein said locking means are adapted to secure said closure means to said housing.

3. A trash collection receptacle as defined in claim 1, wherein said post means comprise corner posts provided at corners of said housing, said corner posts each comprising said second set of vertical channels for receiving said cross member means such that each panel assembly is removable from said frame.

4. A trash collection receptacle as defined in claim 3, wherein locking means are provided for preventing said panel assemblies from being removed from said frame.

5. A trash collection receptacle as defined in claim 4, wherein said locking means comprise elongated members adapted to be horizontally mounted atop said panel assemblies for preventing said panel assemblies from being removed from said frame by slidable displacement thereof upwards along said channels.

6. A trash collection receptacle as defined in claim 5, wherein tamper-proof screw means are provided to secure said elongated members to said frame.

7. A trash collection receptacle as defined in claim 3, wherein said cross member means comprise parallel and horizontal upper and lower beams extending between said corner posts, said lower beams defining horizontal channels for receiving lower ends of said panel assemblies, and wherein said corner posts and said upper and lower beams are extruded elongated members.

8. A trash collection receptacle as defined in claim 7, wherein each one of said panel assemblies comprises parallel inner, outer and intermediate panel means disposed side-by-side, at least said outer panel means being made at least partly of a translucent material for allowing at least part of said intermediate panel means to be viewed from outside of said housing.

9. A trash collection receptacle as defined in claim 8, wherein said inner and intermediate panel means are also at least partly made of at least one translucent material, said intermediate panel means defining at least one representation, lighting means being provided in said housing for illuminating by back-lighting said inner, outer and intermediate panel means such that said representation can be clearly viewed from outside of said housing.

10. A trash collection receptacle comprising an outer housing and an inner trash collection container located in said housing, said housing defining a trash receiving opening such that trash deposited therethrough is collected in said inner container, wherein said housing comprises a frame and at least one panel means mounted thereto, said frame being comprised of corner post means and cross member means assembled thereto, said panel means being at least partly translucent and defining at least one representation, lighting means being provided in said housing for illuminating by back-lighting said panel means such that said representation can be clearly viewed from outside of said housing, at least one of said corner post means defining an inwardly inner channel, wherein said lighting means are mounted to said inner channel of said at least one of said corner post means and inside said housing.

11. A trash collection receptacle as defined in claim 10, wherein each of said corner post means defines an inner channel, said corner post means and said cross member means being extruded components, bracket means being provided for attaching said lighting means to said inner channels, and wherein at least one fire wall is provided in said housing such as to extend between said inner container and said lighting means.

12. A trash collection receptacle as defined in claim 10, wherein said corner post means and said cross member means are extruded components, wiring for said lighting means running in raceways defined in at least one of said corner post means and said cross member means.

13. A trash collection receptacle as defined in claim 3, wherein said second set of vertical channels is disposed inwardly of said first set of vertical channels.

14. A trash collection receptacle as defined in claim 7, wherein said housing comprises a bottom wall, said frame and said panel assemblies extending upwards from said bottom wall and forming side walls of said housing, said lower beams defining inner grooves for receiving peripheral edges of said bottom wall.

15. A housing comprising frame means and panel assemblies adapted to be mounted to said frame means, said frame means being made of at least two extruded post means and of cross member means adapted to be assembled with said post means such as to form said frame means, at least one of said panel assemblies being removable from said frame means, said post means each defining a first set of vertical channels for removably receiving said panel assemblies and a second set of vertical channels for receiving the ends of said cross member means to allow said at least one of said panel assemblies to be selectively removed from said frame means without interference from said upper one of said cross member means.

16. A trash collection receptacle comprising an outer housing and an inner trash collection container located in said housing, said housing defining a trash receiving opening such that trash deposited therethrough is collected in said inner container, wherein said housing comprises a frame and panel assemblies adapted to be mounted thereto, at least one of said panel assemblies being slidably engageable in opposed parallel channels defined in said frame from an open end of said channels until being limited in movement by said frame at a location of said channels remote from said open end whereat said at least one of said panel assemblies is functionally mounted to said housing, disengageably lockable elongated means being provided at said open end such as to extend, in a locked position, between said channels for preventing said at least one of said panel assemblies from being removed from said housing by slidable displacement thereof along said channels and through said open end.

17. A trash collection receptacle as defined in claim 16, wherein each of said panel assemblies is removably mounted to channels of said frame and is locked thereto by lockable elongated means.

18. A trash collection receptacle as defined in claim 17, wherein tamper-proof screw means are provided to lock said elongated means to said housing.

19. A trash collection receptacle as defined in claim 17, wherein a closure is adapted to selectively close said trash receiving opening and to be displaced relative to said housing such as to provide access to said inner trash collection container and to said lockable elongated means, wherein, even when said closure is displaced to provide access to said inner trash collection container, said lockable elongated means prevent said panel assemblies from being removed from housing, locking means being also provided for securing said closure to said housing thereby selectively denying access to said inner trash collection container.

20. A trash collection receptacle as defined in claim 17, wherein each one of said panel assemblies comprises parallel inner, outer and intermediate panel means disposed side-by-side and made at least partly of a translucent material, said intermediate panel means defining at least one representation, lighting means being provided in said housing for illuminating by back-lighting said inner, outer and intermediate panel means such that said representation can be clearly viewed from outside of said housing.

21. A trash collection receptacle comprising an outer housing and an inner trash collection container located in said housing, said housing defining a trash receiving opening such that trash deposited therethrough is collected in said inner container, said housing comprising a frame and at least one panel means mounted thereto, said panel means being at least partly translucent and defining at least one representation, lighting means being mounted to said frame and within said housing for illuminating by back-lighting said panel means such that said representation can be viewed from outside of said housing, wherein at least one fire wall is provided in said housing such as to extend between said inner trash collection container and said lighting means.

22. A trash collection receptacle, as defined in claim 21, wherein said lighting means are mounted vertically along at least one corner post of said frame, said fire wall comprising a peripheral upstanding side wall extending between said lighting means and said inner trash collection container and a bottom wall extending horizontally within said upstanding side wall while extending between a bottom wall said inner container and a bottom wall of said outer housing.

23. A trash collection receptacle as defined in, claim 22, wherein said fire wall further comprises flange means extending from upper ends of said upstanding side wall outwardly towards said frame and at least up adjacent thereto.

* * * * *